United States Patent [19]

Kirchesch et al.

[11] Patent Number: 4,973,806

[45] Date of Patent: Nov. 27, 1990

[54] COMPRESSED-AIR BREAKER

[75] Inventors: Peter Kirchesch, Dossenheim, Fed. Rep. of Germany; Arnold Meier, Wettingen, Switzerland

[73] Assignee: BBC Brown Boveri AG, Baden, Switzerland

[21] Appl. No.: 261,849

[22] Filed: Oct. 25, 1988

[30] Foreign Application Priority Data

Oct. 27, 1987 [CH] Switzerland ..... 4211/87

[51] Int. Cl.[5] ..... H01H 33/42; H01H 33/88

[52] U.S. Cl. ..... 200/148 F; 200/148 A

[58] Field of Search ..... 200/148 R, 148 A, 148 F

[56] References Cited

U.S. PATENT DOCUMENTS

| | | | |
|---|---|---|---|
| 2,055,312 | 9/1936 | Ruppel | 200/148 A |
| 2,330,820 | 10/1943 | Fernier | 200/148 A |
| 3,896,282 | 7/1975 | Chabala | 200/148 F |
| 4,342,891 | 8/1982 | Solver | 200/148 A |

FOREIGN PATENT DOCUMENTS

| | | | |
|---|---|---|---|
| 1029449 | 5/1958 | Fed. Rep. of Germany | 200/148 F |
| 2946929A1 | 5/1981 | Fed. Rep. of Germany . | |
| 2946929C2 | 4/1985 | Fed. Rep. of Germany . | |
| 1448854 | 7/1966 | France . | |
| 524887 | 8/1972 | Switzerland . | |

*Primary Examiner*—Robert S. Macon

*Attorney, Agent, or Firm*—Burns, Doane, Swecker & Mathis

[57] ABSTRACT

The compressed-gas breaker has a movable contact member (1) and a fixed contact member (2) having in each case at least one arcing contact (6, 7) as well as, fixed on the movable contact member (1), a pressure space (10) of a volume independent of the switching travel and storing arc-compressed quenching gas in breaking, and has an insulating nozzle (8) arranged co-axially to the two contact members (1, 2). With this breaker, the parting speed of the arcing contacts (6, 7) is increased significantly with respect to the drive speed without an appreciable increase in its drive energy and without changing its quenching geometry. The arcing contact (7) of the fixed contact member (2) being guided displaceably in axial direction in a sliding contact (14) and being part of a converter element is operated by the movable contact member (7) and arranged downstream of the nozzle constriction (9) of the insulating nozzle (8). In breaking, this converter element transfers the movement of the movable contact member (1) oppositely onto the arcing contact (7) of the fixed contact member (2).

3 Claims, 2 Drawing Sheets

COMPRESSED-AIR BREAKER

BACKGROUND OF THE INVENTION

1. Field of the Invention

The present invention relates to compressed-gas breakers.

2. Background of the Invention

An example of a known compressed-gas breaker can be found in US-A-4,658,108. The known breaker has a pressure space of constant volume, enclosed by the movable member of its two contact members. In breaking, this pressure space is supplied with arc-generated compressed gas for blowing out the arc when the current to be interrupted approaches zero. Although this results in a considerable saving in drive energy in comparison with a compressed-gas breaker in which the compressed gas used for blowing out the arc is generated only by a piston-cylinder compression device operated by a breaker drive, with such a breaker any required increase in the contact-parting speed could previously only be achieved by a considerable increase in the drive energy.

It is known from DE-C2-2,946,929 to increase the parting speed of the power contacts of a compressed-gas breaker by the power contact of the movable contact member being operated by means of a lever arrangement operated by the breaker drive or by a rack-and-pinion gear. However, in this case the quenching geometry of the contact arrangement of the compressed-gas breaker is changed and consequently its quenching capability is affected. In addition, the power contact of the movable contact member in this switch closes the flow outlet of the compression space of a piston-cylinder compression device operated by the breaker drive during breaking for virtually the entire compression phase. Therefore, this breaker requires a comparatively high drive energy.

SUMMARY OF THE INVENTION

The present invention improves upon generic compressed-gas breakers that the contact-parting speed is increased significantly in comparison with the drive speed without any appreciable increase in its drive energy and without changing its quenching geometry.

The present compressed-gas breaker according to the invention is advantageous in switching situation where a high contact-parting speed is important. This is of significance in particular in the switching of capacitive currents, which can be switched in a reliable way and without appreciable increase in the drive energy.

BRIEF DESCRIPTION OF THE DRAWINGS

A more complete appreciation of the invention and many of the attendant advantages thereof will be readily obtained by reference to the following detailed description when considered in connection with the accompanying drawings, wherein.

DETAILED DESCRIPTION OF THE PREFERRED EMBODIMENTS

Figure 1:
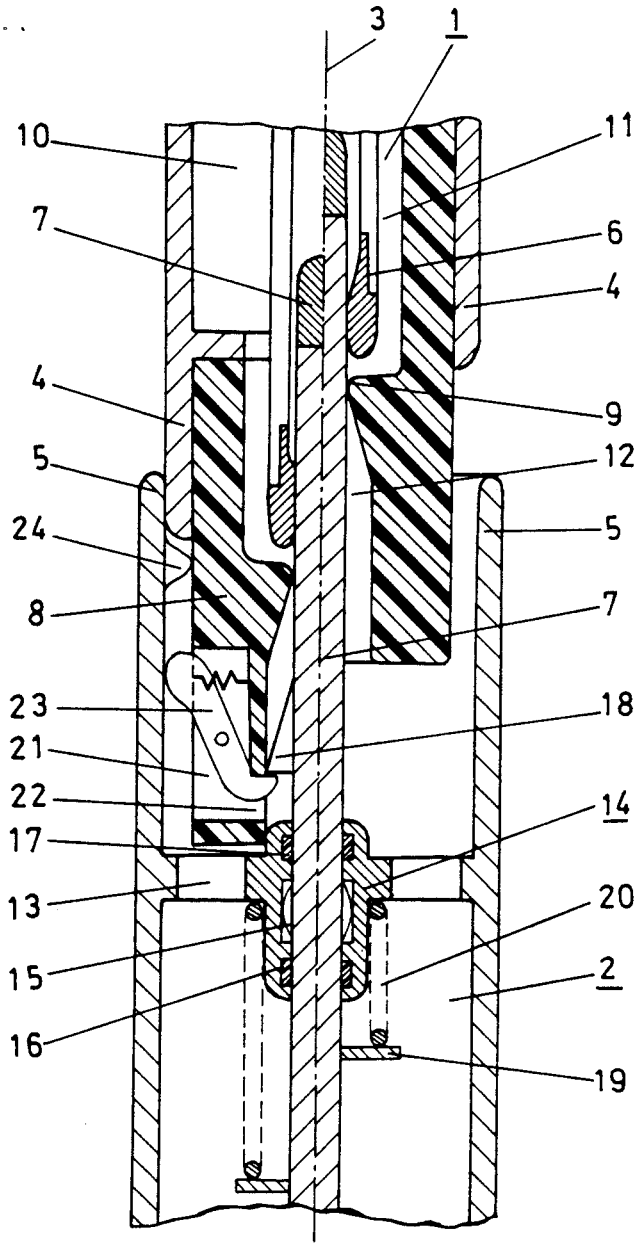
FIG. 1 is a view of an axially taken section through a contact arrangement of an exemplary embodiment of the compressed-gas breaker according to the invention, which is shown in the left-hand part in the making state and in the right-hand part during breaking.

Referring now to the drawings, wherein like reference numerals designate identical or corresponding parts throughout the several views, in FIG. 1 two contact members 1, 2 are shown, which are located in a housing (not shown) filled with insulating gas, and can be brought into and out of engagement with each other along an axis 3. Both contact members 1, 2 are of substantially rotationally symmetrical design and are in each case electrically conductively connected to a power supply point (not shown). Both contact members 1 and 2 have in each case a nominal current contact 4 and 5, respectively, as well as an arcing contact 6 and 7, respectively.

The contact member 1 may be displaced along the axis 3 by a drive (likewise not shown) and has an insulating nozzle 8, which has a nozzle constriction 9, is arranged coaxially between nominal current contact 4 and arcing contact 6 and is connected rigidly to the nominal current contact 4 and arcing contact 6, as well as an annular pressure space 10, which is provided preferably for the storage of compressed gas and can be connected via an annular channel 11, which is provided between arcing contact 6 and inner wall of the insulating nozzle 8, and via the nozzle constriction 9 to an exhaust space 12, located downstream of the nozzle constriction 9.

The contact member 2 contains a sliding contact 14, which is coaxially surrounded by the nominal current contact 5, connected via electrically conductive segments 13 to the nominal current contact 5 and in which the arcing contact 7, designed in the form of a pin, is guided displaceably in the axial direction. In this arrangement, the current transfer from the sliding contact 14 to the arcing contact 7 is ensured by contact laminations 15, the guidance of the arcing contact 7 being ensured by bearing rings 16 and 17, consisting for example of poly- tetrafluoroethlene.

On the arcing contact 7 there are fixed a latching part 18 and a washer 19, against which a compression spring 20 bears with its lower end. The upper end of the compression spring 20 bears against the sliding contact 14. In the insulating nozzle 8 there is provided a recess 21, which is arranged substantially downstream of the nozzle constriction 9 and in which a spring-loaded latch 23, interacting with the latching part 18 through an opening 22 provided downstream of the nozzle constriction 9, is rotatably mounted. A lug 24, interacting with the latch 23, is fixed on the inner surface of the nominal current contact 5.

In breaking, the contact member 1 is moved upward along the axis 3 by the drive (not shown). After a predetermined travel, the two nominal current contacts 4, 5 part and the current to be interrupted commutates into a current path formed by the arcing contacts 6, 7. The arcing contact 7 held by the latch 23 meanwhile keeps following the contact member 1 at the same speed and with charging of the compression spring 20 until the latch 23 acting as block is turned clockwise after a predetermined period of time by coming up against the fixed lug 24. This has the effect that the latching part 18, and thus also the arcing contact 7 acting as tensioning part of a tensioning mechanism, are released. Under the action of the now charged compression spring 20, the arcing contact 7 reverses its direction of movement (right-hand part of FIG. 1) and the two arcing contacts 6 and 7 are then driven oppositely. Due to the comparatively low inert mass of the arcing contact 7 and a suitably measured depth of penetration of the arcing contact 7 in the hollow arcing contact 6, even if a comparatively weakly dimensioned compression spring 20 is used, a high speed of the arcing contact 7, approximately equivalent to the drive speed but in the opposite direction, is achieved at the moment of parting of the two arcing contacts 6 and 7. At the moment of contact parting, the two arcing contacts 6 and 7 therefore move apart at approximately twice the drive speed.

In contact parting, an arc is drawn between the arcing contacts 6 and 7, which fills the pressure space 10 with heated insulating gas. After release of the nozzle constriction 9 by the arcing contact 7, the arc is blown out by the insulating gas stored in the pressure space 10 and quenched when the interrupted current approaches zero. Due to the high contact-parting speed, it is thereby ensured that the insulating distance between the two arcing contacts 6 and 7 is large enough to be able to withstand the returning voltage. Particularly when switching capacitive currents, the contact-parting speed is the limiting parameter, which can be increased significantly in a simple way by the described measures in relation to a comparative breaker according to the prior art, without excessively increasing the drive energy and without changing the quenching geometry of the contact arrangement.

Figure 2:
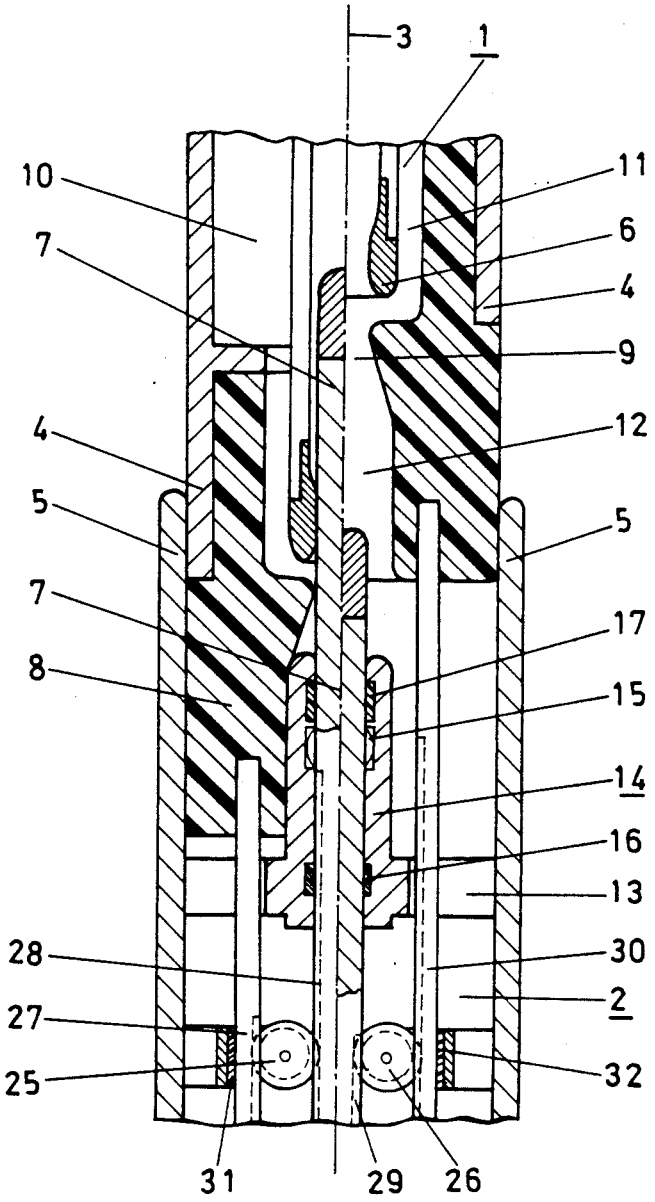
FIG. 2 is a plan view of an axially taken section through a contact arrangement of a further exemplary embodiment of a compressed-gas breaker according to the invention, which is shown in the left-hand part in the making state and the right-hand part in the breaking state.

In the case of the exemplary embodiment of the compressed-gas breaker according to the invention shown in FIG. 2, an increased contact-parting speed is achieved without changing the quenching behavior of the contact arrangement by a rack-and-pinion gear being used as converter element instead of a blocking mechanism. In this arrangement, the rack-and-pinion gear has two gear wheels 25, 26, which are in each case mounted on the contact member 2 rotatably about an azimuthally guided axis, as well as four toothed racks 27 to 30, which are aligned in parallel with the axis 3 and of which the toothed racks 27 and 30 are in each case fixed on the downstream end of the insulating nozzle 8 and are in each case in engagement by radially inwardly directed teeth with radially outwardly pointing teeth of the gear wheel 25 and 26, respectively. The toothed racks 28 and 29 are recessed into diametrically opposed outer surfaces of the arcing contact 7, displaceable in the direction of the axis 3.

In the case of this embodiment of the compressedgas breaker according to the invention, in breaking the movable contact member 1, and thus also the toothed racks 27 and 30, are taken upward. This upwardly directed movement is converted by means of the gear wheels 25 and 26 on the toothed racks 28 and 29 into a movement of the arcing contact 7, taking place at the same speed but in the opposite direction. In contact parting, then the arcing contacts 6 and 7 are moved apart at twice the drive speed, while retaining the quenching geometry of the contact arrangement.

By using two gear wheels 25 and 26, arranged diametrically with respect to the axis 3, a virtually force-free guidance of the toothed racks 28, 29 supported on sliding bearings 31 and 32, respectively, and consequently also of the arcing contacts 7, is achieved, as a result of which considerable drive energy can be saved. Accordingly, drive energy can also be saved in the case of the embodiment according to FIG. 1 if, in breaking, the arcing contact 7 is initially held by two latches 23 arranged diametrically with respect to the axis 3.

Obviously, numerous modifications and variations of the present invention are possible in light of the above teachings. It is therefore to be understood that, within the scope of the appended claims, the invention may be practised otherwise than as specifically described herein.

What is claimed as new and desired to be secured by letters patent of the United States is:

1. A compressed-gas circuit breaker, comprising:

(a) movable and stationary contact members movable relative to each other along an axis and each member movable relative to each other along an axis and each member having at least an arcing contact, (b) a pressure space formed in said movable contact member for storing compressed quenching gas during an opening procedure of the breaker, said pressure space having a volume independent of the travel of said contact members, (c) an insulating nozzle, arranged coaxially to said contact members and fixed on said movable contact member, wherein said nozzle includes an orifice which, during closing of the breaker, passes by the arcing contact of said stationary contact member and, during opening of the breaker, connects said pressure space to an exhaust space, (d) a sliding contact, displaceable in an axial direction, for guiding said arcing contact of said stationary contact member, (e) a compression spring acting on said arcing contact of said stationary contact member, (f) a blocking mechanism arranged downstream from said orifice of said insulating nozzle, including said arcing contact of said stationary contact member and a latch rotatably mounted in said insulating nozzle such that one end of the latch is movable through said nozzle orifice into said exhaust space, and (g) a latching part arranged on said arcing contact of said stationary contact member for interacting with said latch, (h) wherein said arcing contact of said stationary contact member penetrates said movable contact member in a closed position of the breaker and charges said compression spring at the beginning of the opening procedure, and, (i) wherein said charged compression spring, after release of said latching part, moves said arcing contact of said stationary contact member oppositely to said movable contact member.

2. A compressed-gas circuit breaker, comprising:

(a) movable and stationary contact members movable relative to each other along an axis and each member having at least an arcing contact, (b) a pressure space formed in said movable contact member for storing compressed quenching gas during an opening procedure of the breaker, said pressure space having a volume independent of the travel of said contact members, (c) an insulating nozzle, arranged coaxially to said contact members and fixed on said movable contact member, wherein said nozzle includes an orifice which, during closing of the breaker, passes by the arcing contact of said stationary contact member and during opening of the breaker, connects said pressure space to an exhaust space, (d) a sliding contact, displaceable in an axial direction, for guiding said arcing contact of said stationary contact member, (e) a rack and pinion gear having at least one gear wheel rotatably mounted on said stationary contact member and at least two toothed racks arranged in parallel with said axis and interacting with said at least one gear wheel, wherein at least a first toothed rack is fixed on said insulating nozzle and at least a second toothed rack is recessed into said arcing contact of said stationary contact member, (f) wherein said arcing contact of said stationary contact penetrates said movable contact member in a closed position of the breaker and at the beginning of the opening procedure, and (g) wherein said rack and pinion gear, during the opening of the breaker, transfers the movement of said movable contact member oppositely onto said arcing contact of said stationary contact member.

3. The circuit breaker according to claim 2, wherein said rack and pinion gear acts at two points arranged diametrically with respect to said axis on said arcing contact of said stationary contact.

* * * * *